US009647346B2

(12) United States Patent
Park et al.

(10) Patent No.: US 9,647,346 B2
(45) Date of Patent: May 9, 2017

(54) OMNIDIRECTIONAL ANTENNA

(71) Applicant: Electronics and Telecommunications Research Institute, Daejeon (KR)

(72) Inventors: Juderk Park, Daejeon (KR); Nae-soo Kim, Daejeon (KR); Cheol Sig Pyo, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 14/728,273

(22) Filed: Jun. 2, 2015

(65) Prior Publication Data

US 2016/0099506 A1 Apr. 7, 2016

(30) Foreign Application Priority Data

Oct. 2, 2014 (KR) ..... 10-2014-0133487

(51) Int. Cl.

| | |
|---|---|
| ***H01Q 1/00*** | (2006.01) |
| ***H01Q 21/29*** | (2006.01) |
| ***H01Q 1/36*** | (2006.01) |
| ***H01Q 9/32*** | (2006.01) |

(52) U.S. Cl.

CPC ..... *H01Q 21/29* (2013.01); *H01Q 1/00* (2013.01); *H01Q 1/36* (2013.01); *H01Q 9/32* (2013.01)

(58) Field of Classification Search

CPC H01Q 21/29; H01Q 9/32; H01Q 1/36; H01Q 1/00

USPC ..... 343/729

See application file for complete search history.

(56) References Cited

U.S. PATENT DOCUMENTS

| | | | | |
|---|---|---|---|---|
| 4,583,099 | A * | 4/1986 | Reilly | G01V 15/00 257/E27.114 |
| 5,808,587 | A * | 9/1998 | Shima | G07C 9/00103 340/10.34 |
| 6,369,778 | B1 * | 4/2002 | Dockery | H01Q 1/36 343/895 |
| 6,864,856 | B2 * | 3/2005 | Lynch | H01Q 9/27 343/853 |
| 2010/0066624 | A1 | 3/2010 | Masuda et al. | |
| 2010/0289716 | A1 | 11/2010 | Lenzi et al. | |

FOREIGN PATENT DOCUMENTS

| | | |
|---|---|---|
| KR | 10-0400062 B1 | 9/2003 |
| KR | 10-0991966 B1 | 11/2010 |
| KR | 10-1062227 B1 | 9/2011 |

* cited by examiner

*Primary Examiner* — Brian Young

(74) *Attorney, Agent, or Firm* — Nelson Mullins Riley & Scarborough LLP

(57) ABSTRACT

An omnidirectional antenna is provided. The omnidirectional antenna includes a spiral antenna including a substrate, at least one upper antenna pattern formed on the substrate, and at least one lower antenna pattern formed under the substrate and connected to the upper antenna pattern; and a monopole antenna that supports the spiral antenna and that is connected to the spiral antenna. Therefore, by forming an omnidirectional antenna in a spiral antenna having an upper antenna pattern and a lower antenna pattern at an upper surface and a lower surface, respectively, of a substrate, three-dimensional current flow is available and thus omnidirectional radiation characteristics may be exhibited.

6 Claims, 4 Drawing Sheets

OMNIDIRECTIONAL ANTENNA

CROSS-REFERENCE TO RELATED APPLICATION

This application claims priority to and the benefit of Korean Patent Application No. 10-2014-0133487 filed in the Korean Intellectual Property Office on Oct. 2, 2014, the entire contents of which are incorporated herein by reference.

BACKGROUND OF THE INVENTION (a) Field of the Invention

The present invention relates to an omnidirectional antenna.

(b) Description of the Related Art

In general, a spiral antenna that is used for a wireless transmission apparatus exhibits wideband characteristics and has simple parameters for production to be widely used. Such a spiral antenna is produced by forming a metal pattern of a spiral structure at a substrate of a plane structure, and is an antenna in which a main radiation direction is formed in a direction perpendicular to the plane. A Radio Frequency (RF) power supply unit of such a spiral antenna is located at the center of the spiral antenna.

However, because an antenna that is mounted in a terminal or a communication node of a general mobile communication system or sensor network system requires omnidirectional radiation characteristics, the antenna uses an antenna of a monopole or dipole shape, and the plane antenna is changed and used to correspond to a shape of a communication apparatus so as to exhibit omnidirectional radiation characteristics. However, because a size of such an antenna should be about ¼ of a wavelength of a frequency used, the size of the antenna increases.

A plane inverse F-type antenna and an internal PCB antenna have a simple structure and a small size, but have a small frequency bandwidth and a small antenna gain and do not represent an omnidirectional radiation shape by interference or electromagnetic mutual coupling with a cover or an internal component of a wireless transmission apparatus.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an omnidirectional antenna having advantages of operating in a wide frequency band and having a small size.

An exemplary embodiment of the present invention provides an omnidirectional antenna including: a spiral antenna including a substrate, at least one upper antenna pattern formed on the substrate, and at least one lower antenna pattern formed under the substrate and connected to the upper antenna pattern; and a monopole antenna that supports the spiral antenna and that is connected to the spiral antenna.

The upper antenna pattern and the lower antenna pattern may be connected through a connection pin that is formed in the substrate.

The upper antenna pattern and the lower antenna pattern may be formed in a spiral shape.

A spiral final end portion of the upper antenna pattern may be connected to a spiral start end portion of the lower antenna pattern.

The upper antenna pattern and the lower antenna pattern may not be overlapped.

A start end portion of the upper antenna pattern may be connected to an end portion of the monopole antenna.

The substrate may have a circular shape.

The omnidirectional antenna may further include an antenna cover that covers the spiral antenna and the monopole antenna.

DETAILED DESCRIPTION OF THE EMBODIMENTS

Figure 1:
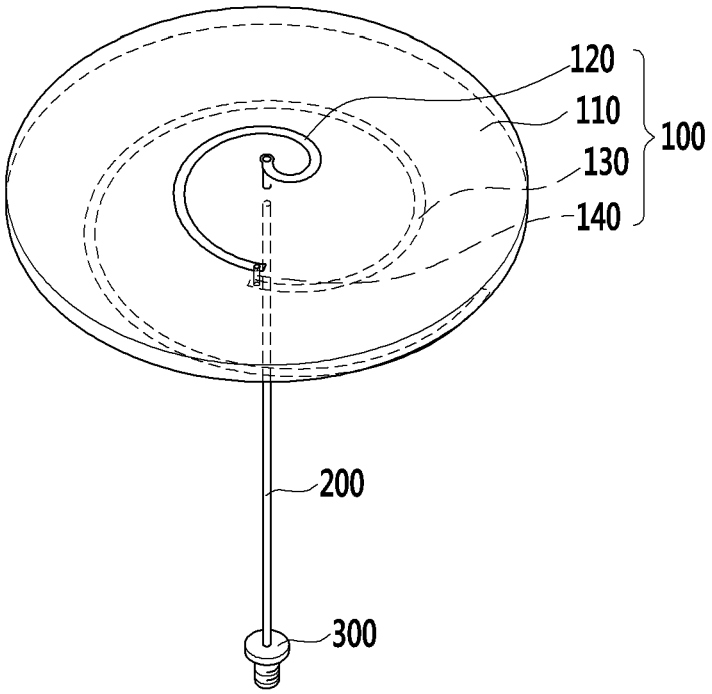
FIG. 1 is a perspective view illustrating an omnidirectional antenna according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

The drawings and description are to be regarded as illustrative in nature and not restrictive. Like reference numerals designate like elements throughout the specification.

Hereinafter, an omnidirectional antenna according to an exemplary embodiment of the present invention will be described in detail with reference to FIGS. 1 to 4.

Figure 2:
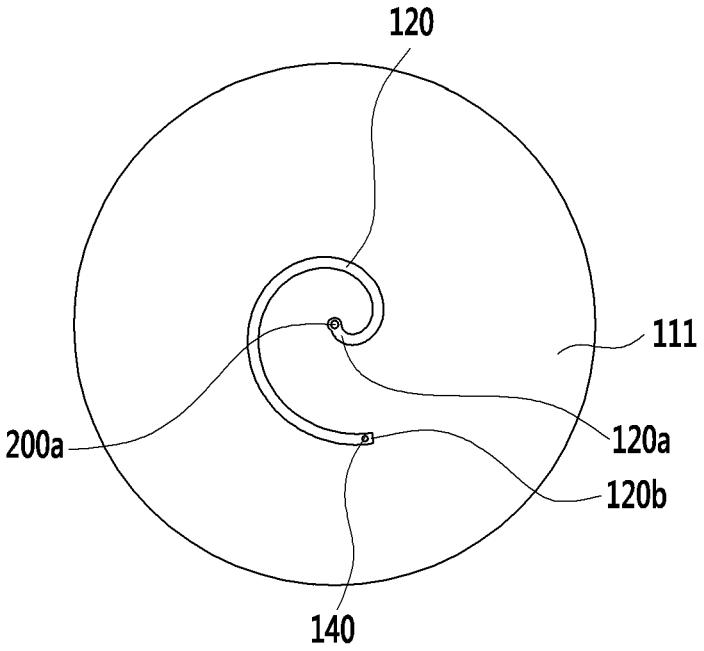
FIG. 2 is a top plan view of an upper portion of a spiral antenna of FIG. 1.
Figure 3:
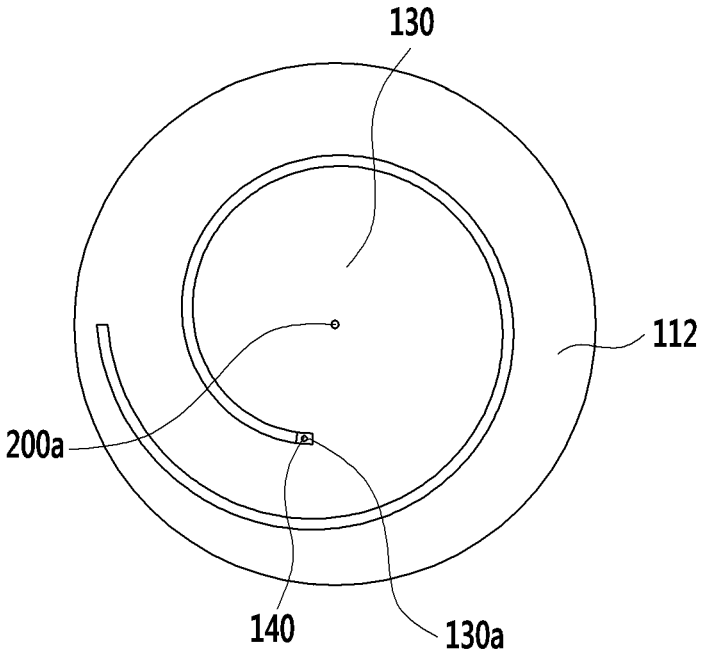
FIG. 3 is a top plan view of a lower portion of a spiral antenna of FIG. 1.
Figure 4:
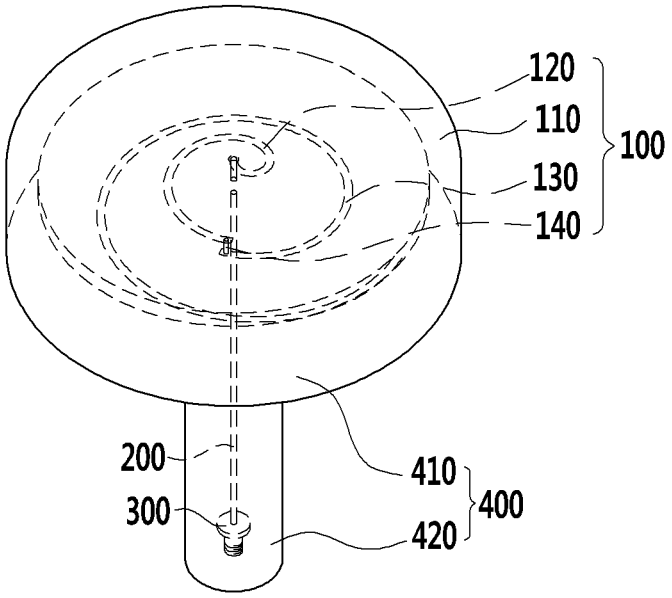
FIG. 4 is a perspective view illustrating a state in which an antenna cover is covered in an omnidirectional antenna according to an exemplary embodiment of the present invention.

FIG. 1 is a perspective view illustrating an omnidirectional antenna according to an exemplary embodiment of the present invention, FIG. 2 is a top plan view of an upper portion of a spiral antenna of FIG. 1, FIG. 3 is a top plan view of a lower portion of a spiral antenna of FIG. 1, and FIG. 4 is a perspective view illustrating a state in which an antenna cover is covered in an omnidirectional antenna according to an exemplary embodiment of the present invention.

As shown in FIGS. 1 to 4, an omnidirectional antenna according to an exemplary embodiment of the present invention includes a spiral antenna 100 and a monopole antenna 200 that supports and is connected to the spiral antenna 100.

The spiral antenna 100 includes a substrate 110, at least one upper antenna pattern 120 formed on the substrate 110, and at least one lower antenna pattern 130 formed under the substrate 110 and connected to the upper antenna pattern 120.

The substrate 110 may have a circular shape and may be a Printed Circuit Board (PCB).

The upper antenna pattern 120 is formed in a spiral metal pattern at an upper surface 111 of the substrate 110, and a spiral start end portion 120*a* of the upper antenna pattern 120 is formed in a central portion of the substrate 110.

Further, the lower antenna pattern 130 is formed in a spiral metal pattern at a lower surface 112 of the substrate 110, and the upper antenna pattern 120 and the lower antenna pattern 130 are not overlapped. That is, a spiral start end portion 130*a* of the lower antenna pattern 130 is formed at a location corresponding to a spiral final end portion 120*b* of the upper antenna pattern 120, and the lower antenna pattern 130 is formed in a spiral shape from the spiral start end portion 130*a* to an outer edge.

Such a spiral final end portion 120*b* of the upper antenna pattern 120 is connected to the spiral start end portion 130*a* of the lower antenna pattern 130 through a connection pin 140 that is made of a metal at the substrate 110.

Therefore, by enabling a current flowing to the upper antenna pattern 120 to flow to the lower antenna pattern 130, a current flows in three dimensions.

The spiral start end portion 120*a* of the upper antenna pattern 120 is connected to an end portion 200*a* of the monopole antenna 200, and a connection connector 300 connected to a terminal or a communication node of a mobile communication system or a sensor network system is installed at the other end portion of the monopole antenna 200. A current that is transferred from the terminal or the communication node to the monopole antenna 200 through the connection connector 300 is supplied to the start end portion 120*a* of the upper antenna pattern 120.

Such a monopole antenna 200 separates the spiral antenna 100 and a metal portion of the terminal or the communication node by a predetermined gap, and thus interference with a case or an internal component of the terminal or the communication node can be reduced.

In this way, as the spiral antenna 100 forms the upper antenna pattern 120 and the lower antenna pattern 130 at the upper surface 111 and the lower surface 112 of the substrate 110, respectively, a three-dimensional current flow is available and thus omnidirectional radiation characteristics may be exhibited.

Further, both the upper antenna pattern 120 and the lower antenna pattern 130 have a spiral shape, and thus the upper antenna pattern 120 and the lower antenna pattern 130 may have wideband characteristics operating in a wide frequency band while having a small size.

In addition, the spiral antenna 100 can be produced in a small size compared with a dipole antenna having omnidirectional radiation characteristics, and because the spiral antenna 100 can be formed by printing the upper antenna pattern 120 and the lower antenna pattern 130 in the substrate 110, production errors are reduced.

As shown in FIG. 4, an antenna cover 400 including a first cover 410 and a second cover 420 that cover the spiral antenna 100 and the monopole antenna 200, respectively, may be installed. Because such the antenna cover 400 is made of a nonmetallic material, the antenna cover 400 can prevent interference with the spiral antenna 100 and the monopole antenna 200.

By forming an omnidirectional antenna according to an exemplary embodiment of the present invention in a spiral antenna having an upper antenna pattern and a lower antenna pattern at an upper surface and a lower surface, respectively, of a substrate, a three-dimensional current flow is available and thus omnidirectional radiation characteristics can be exhibited.

Further, because both the upper antenna pattern and the lower antenna pattern have a spiral shape, the upper antenna pattern and the lower antenna pattern can have wideband characteristics operating in a wide frequency band while having a small size.

Further, an omnidirectional antenna can be produced in a small size, compared with a dipole antenna having omnidirectional radiation characteristics, and because the omnidirectional antenna can be formed by printing an upper antenna pattern and a lower antenna pattern at a substrate, production errors are reduced.

Further, an omnidirectional antenna according to an exemplary embodiment of the present invention separates a spiral antenna and a metal portion of a terminal or communication node by a predetermined gap by a monopole antenna, and thus performance deterioration by interference or mutual coupling with a case or an internal component of the terminal or the communication node is less such that the omnidirectional antenna can be applied as an antenna for various wireless transmission apparatuses.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An omnidirectional antenna, comprising:

a spiral antenna comprising a substrate, at least one upper antenna pattern formed on the substrate, and at least one lower antenna pattern formed under the substrate and connected to the upper antenna pattern;

wherein the upper antenna pattern and the lower antenna pattern are formed in a spiral shape;

wherein a spiral final end portion of the upper antenna pattern is connected to a spiral start end portion of the lower antenna pattern; and a monopole antenna that supports the spiral antenna and that is connected to the spiral antenna.

2. The omnidirectional antenna of claim 1, wherein the upper antenna pattern and the lower antenna pattern are connected through a connection pin that is formed in the substrate.

3. The omnidirectional antenna of claim 1, wherein the upper antenna pattern and the lower antenna pattern are not overlapped.

4. The omnidirectional antenna of claim 1, wherein a start end portion of the upper antenna pattern is connected to an end portion of the monopole antenna.

5. The omnidirectional antenna of claim 1, wherein the substrate has a circular shape.

6. The omnidirectional antenna of claim 1, further comprising an antenna cover that covers the spiral antenna and the monopole antenna.

* * * * *